US009487737B2

(12) United States Patent
Tan et al.

(10) Patent No.: US 9,487,737 B2
(45) Date of Patent: Nov. 8, 2016

(54) STRUCTURED PARTICLES COMPRISING AN ALKOXYLATED POLYALKYLENEIMINE, AND GRANULAR LAUNDRY DETERGENT COMPRISING THE SAME

(71) Applicant: The Procter & Gamble Company, Cincinnati, OH (US)

(72) Inventors: HongSing Tan, Beijing (CN); Daitao Geng, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/794,842

(22) Filed: Jul. 9, 2015

(65) Prior Publication Data

US 2016/0010033 A1 Jan. 14, 2016

(30) Foreign Application Priority Data

Jul. 11, 2014 (WO) ..... PCT/CN2014/082035

(51) Int. Cl.

| | |
|---|---|
| ***C11D 3/10*** | (2006.01) |
| ***C11D 7/32*** | (2006.01) |
| ***C11D 11/02*** | (2006.01) |
| ***C11D 3/04*** | (2006.01) |
| ***C11D 3/12*** | (2006.01) |
| ***C11D 3/37*** | (2006.01) |
| ***C11D 17/06*** | (2006.01) |

(52) U.S. Cl.

CPC ..... *C11D 3/046* (2013.01); *C11D 3/10* (2013.01); *C11D 3/124* (2013.01); *C11D 3/3723* (2013.01); *C11D 7/32* (2013.01); *C11D 17/06* (2013.01)

(58) Field of Classification Search

CPC ..... C11D 3/10; C11D 3/124; C11D 3/3723; C11D 7/32; C11D 11/02

See application file for complete search history.

(56) References Cited

U.S. PATENT DOCUMENTS

| | | | |
|---|---|---|---|
| 6,566,323 | B1 | 5/2003 | Littig et al. |
| 7,820,610 | B2 | 10/2010 | Showell et al. |
| 8,097,579 | B2 | 1/2012 | Danziger et al. |
| 8,247,368 | B2 | 8/2012 | Danziger et al. |

FOREIGN PATENT DOCUMENTS

| | | | | |
|---|---|---|---|---|
| WO | WO 98/13463 | * | 4/1998 | ..... C11D 3/386 |
| WO | WO 98/13463 A1 | | 4/1998 | |

OTHER PUBLICATIONS

International Search Report; International Application No. PCT/CN2014/082035; date of mailing Apr. 14, 2015; 5 pages.

* cited by examiner

*Primary Examiner* — Brian P Mruk

(74) *Attorney, Agent, or Firm* — John T. Dipre; Steven W. Miller

(57) ABSTRACT

This invention relates to structured particles suitable for use in granular laundry detergent compositions, which contain an alkoxylated polyalkyleneimine in combination with a water-soluble alkali metal carbonate and silica and which contains little or no surfactant.

16 Claims, 2 Drawing Sheets

STRUCTURED PARTICLES COMPRISING AN ALKOXYLATED POLYALKYLENEIMINE, AND GRANULAR LAUNDRY DETERGENT COMPRISING THE SAME

FIELD OF THE INVENTION

The present invention relates to structured particles containing an alkoxylated polyalkyleneimine, which are formed by an agglomeration process and are particularly suitable for use in forming granular laundry detergent products.

BACKGROUND OF THE INVENTION

Modern day consumers desire laundry detergents that provide excellent overall cleaning benefit with minimal environmental impact. The detergent industry has traditionally utilized surfactants to deliver the cleaning benefit. However, due to increasing environmental concerns, as well as rising costs of raw materials, the conventional way of either solely or heavily relying on surfactants to achieve the cleaning benefit is gradually losing favor with the modern day consumers.

Correspondingly, laundry detergent manufacturers are exploring new ways to reduce the amount of surfactants used in their products and to minimize the adverse impact of laundering on the environment, while still providing the consumer with excellent overall cleaning results.

Alkoxylated polyalkyleneimines are a group of polymers having a polyalkyleneimine backbone or core that is surrounded by polyalkylene oxide blocks. They have been used as detergent additives in low-surfactant detergent formulations to assist removal of soil from the fabric surface, stabilize suspension of soils dispersed in the wash liquor, and to prevent the suspended soil from redepositing back onto the fabric surface. For example, U.S. Pat. Nos. 8,097,579 and 8,247,268 disclose a group of water-soluble alkoxylated polyalkyleneimines that provide improved grease cleaning benefits, even at lower surfactant levels or at reduced temperatures. The use of such alkoxylated polyalkyleneimines enables reduction of the total surfactant level in laundry detergent products. Correspondingly, less surfactant is released into the environment after each wash, resulting in reduced environmental "footprint" of such laundry detergent products. Further, consumers will be able to accomplish the same cleaning benefit at lower washing temperature, e.g., using cold water, resulting in reduced carbon footprint of the laundering process.

Alkoxylated polyalkyleneimines have also been used as suds collapser to reduce the amount of water needed for rinsing off the laundry detergents after wash. Although high suds volume is desired during the wash cycle of laundering process to signal effective and sufficient cleaning, it is undesirable to have too much residue suds during the rinse cycle of laundering process because the residue suds signals to the consumer that there is still residue surfactant on the fabric and that additional rinsing is needed. Consequently, the consumer will keep rinsing the fabric until all the suds disappear, which inevitably leads to excessive water consumption. It is therefore desirable to use suds collapser, such as alkoxylated polyalkyleneimines, to help reduce or suppress suds during the rinse cycle. For example, U.S. Pat. No. 7,820,610 discloses the use of alkoxylated polyalkyleneimines as a suds collapser in laundry detergent formulations, which helps to reduce rinse suds and thereby prevent the consumer from using an excessive amount of water for rinsing. Correspondingly, the overall demand for water by the laundering process can be significantly reduced, which is an additional benefit that is particularly important for regions where water is a scarce resource.

It is clear that incorporation of alkoxylated polyalkyleneimines into laundry detergent products can effectively reduce the total amount of surfactants needed therein and minimize the adverse impact of laundering process on the environment, while still providing the consumer with excellent overall cleaning results.

However, alkoxylated polyalkyleneimines are viscous and therefore in the past they have been used mostly in liquid laundry detergent formulations. Although it is possible to try incorporating the alkoxylated polyalkyleneimines into dry powder or granular laundry detergent formulations by directly spraying a solution of such polymers onto already formed detergent granules containing surfactants and other detersive actives, the sprayed-on polymer may adversely affect the surface properties of the detergent granules, resulting in finished products with poorer flowability and higher tendency to "cake" over time.

There is therefore a need to provide alkoxylated polyalkyleneimines in a form that can be easily incorporated into granular or powder laundry detergent formulations with better flowability, reduced cake strength (i.e., lower tendency to "cake" over time) and overall product physical stability.

SUMMARY OF THE INVENTION

The present invention discovered that the above-mentioned need can be readily met by agglomerating alkoxylated polyalkyleneimines with a water-soluble alkali metal carbonate and silica, and optionally a water-soluble alkali metal sulfate, to form structured particles of good flowability, which are easy to handle and can be readily incorporated into granular or powder laundry detergent formulations by simple mixing. The so-formed structured particles are surfactant-free, so incorporation of such particles into laundry detergents does not increase the total surfactant content in the detergents. More importantly, granular laundry detergents containing such structured particles exhibit improved flowability and reduced cake strength, in comparison with granular laundry detergents containing the same amount of alkoxylated polyalkyleneimines but which are sprayed onto the surface of surfactant-containing detergent granules. Further, granular laundry detergents containing the structured particles of the present invention have exhibited lower suds volume, in comparison with granular laundry detergents containing the same amount of alkoxylated polyalkyleneimines but which are sprayed onto the surface of surfactant-containing detergent granules, so the structured particles may be useful for forming low suds laundry detergent products.

In one aspect, the present invention relates to a structured particle containing: (a) from about 10 wt % to about 50 wt % of an alkoxylated polyalkyleneimine; (b) from about 20 wt % to about 70 wt % of a water-soluble alkali metal carbonate; and (c) from about 1 wt % to about 20 wt % of silica; (d) from 0 wt % to about 40 wt % of a water-soluble alkali metal sulfate. Such structured particle is characterized by a particle size distribution Dw50 ranging from 250 microns to 1000 microns and a bulk density ranging from 500 to 1500 g/L, and it has a total surfactant level of from 0 wt % to 5 wt %. Preferably but not necessarily, the water-soluble alkali metal carbonate and optionally the water-soluble alkali metal sulfate are mixed together in a mechanical mixer in presence of the alkoxylated polyalkyleneimine to form the structured particle by agglomeration.

In another aspect, the present invention relates to a structured particle that contains: (a) from about 25 wt % to about 40 wt % of an alkoxylated polyalkyleneimine having an empirical formula of $(PEI)_a(CH_2CH_2O)_b(CH_2CH_2CH_2O)_c$; (b) from about 30 wt % to about 40 wt % of sodium carbonate particles having a particle size distribution Dw50 ranging from about 180 microns to about 220 microns; and (c) from about 10 wt % to about 15 wt % of a hydrophilic silica comprising less than about 10% residual salt by total weight of the silica, while the hydrophilic silica is capable of forming swollen silica particles upon hydration, and while the swollen silica particles have a particle size distribution Dv50 of from about 1 μm to about 100 μm. Specifically, PEI stands for a polyethyleneimine (PEI) core; a is the average number-average molecular weight ($MW_n$) of the PEI core prior to modification that ranges from about 500 to about 1000; b is the weight average number of ethylene oxide ($CH_2CH_2O$) units per nitrogen atom in the PEI core, which is an integer ranging from about 20 to about 40; c is the weight average number of propylene oxide ($CH_2CH_2CH_2O$) units per nitrogen atom in the PEI core, which is an integer ranging from about 2 to about 10. Such structured particle is characterized by a particle size distribution Dw50 ranging from about 250 microns to about 1000 microns and a bulk density ranging from about 500 to about 1500 g/L, and wherein said structured particle has a moisture content of less than about 4 wt %.

In a further aspect, the present invention relates to a structured particle containing: (a) from about 20 wt % to about 30 wt % of an alkoxylated polyalkyleneimine having an empirical formula of $(PEI)_a(CH_2CH_2O)_b(CH_2CH_2CH_2O)_c$, as described hereinabove; (b) from about 40 wt % to about 60 wt % of sodium carbonate particles having a particle size distribution Dw50 ranging from about 70 microns to about 90 microns; (c) from about 3 wt % to about 5 wt % of a hydrophilic silica comprising less than about 10% residual salt by total weight of the silica, while the hydrophilic silica is capable of forming swollen silica particles upon hydration, and while such swollen silica particles have a particle size distribution Dv50 of from about 5 μm to about 50 μm; and (d) from about 20 wt % to about 30 wt % of sodium sulfate particles having a particle size distribution Dw50 ranging from about 180 microns to about 220 microns. Such structured particle is characterized by a particle size distribution Dw50 ranging from about 250 microns to about 1000 microns and a bulk density ranging from about 500 to about 1500 g/L, and wherein said structured particle has a moisture content of less than about 4 wt %.

Yet another aspect of the present invention relates to a granular detergent composition containing from about 1 wt % to about 10 wt % of the above-described structured particles. Such a granular detergent composition may further contain from about 1 wt % to about 99 wt % of one or more surfactants, which are, for example, anionic surfactants, cationic surfactants, nonionic surfactants, amphoteric surfactants, and/or mixtures thereof.

Still another aspect of the present invention relates to a method of forming structured particles, which includes the steps of: (a) providing from about 10 part to about 50 parts, by a total weight of 100 parts, of an alkoxylated polyalkyleneimine in a paste form; and (b) mixing the alkoxylated polyalkyleneimine paste with from about 20 parts to about 70 parts of a water-soluble alkali metal carbonate, from about 1 part to about 20 parts of silica, and from 0 parts to about 40 parts of a water-soluble alkali metal sulfate, by a total weight of 100 parts, to form structured particles, provided that the water-soluble alkali metal carbonate is in a particulate form having a particle size distribution Dw50 ranging from about 10 microns to about 100 microns, that the silica is in a particulate form characterized by a particle size distribution Dw50 ranging from about 3 microns to about 30 microns, and that the water-soluble alkali metal sulfate is in a particulate form characterized by a particle size distribution Dw50 ranging from about 50 microns to about 250 microns. The structured particles so formed are characterized by a particle size distribution Dw50 ranging from about 250 microns to about 1000 microns and a bulk density ranging from about 500 to about 1500 g/L.

These and other aspects of the present invention will become more apparent upon reading the following drawings and detailed description of the invention.

DETAILED DESCRIPTION OF THE INVENTION

Figure 1:
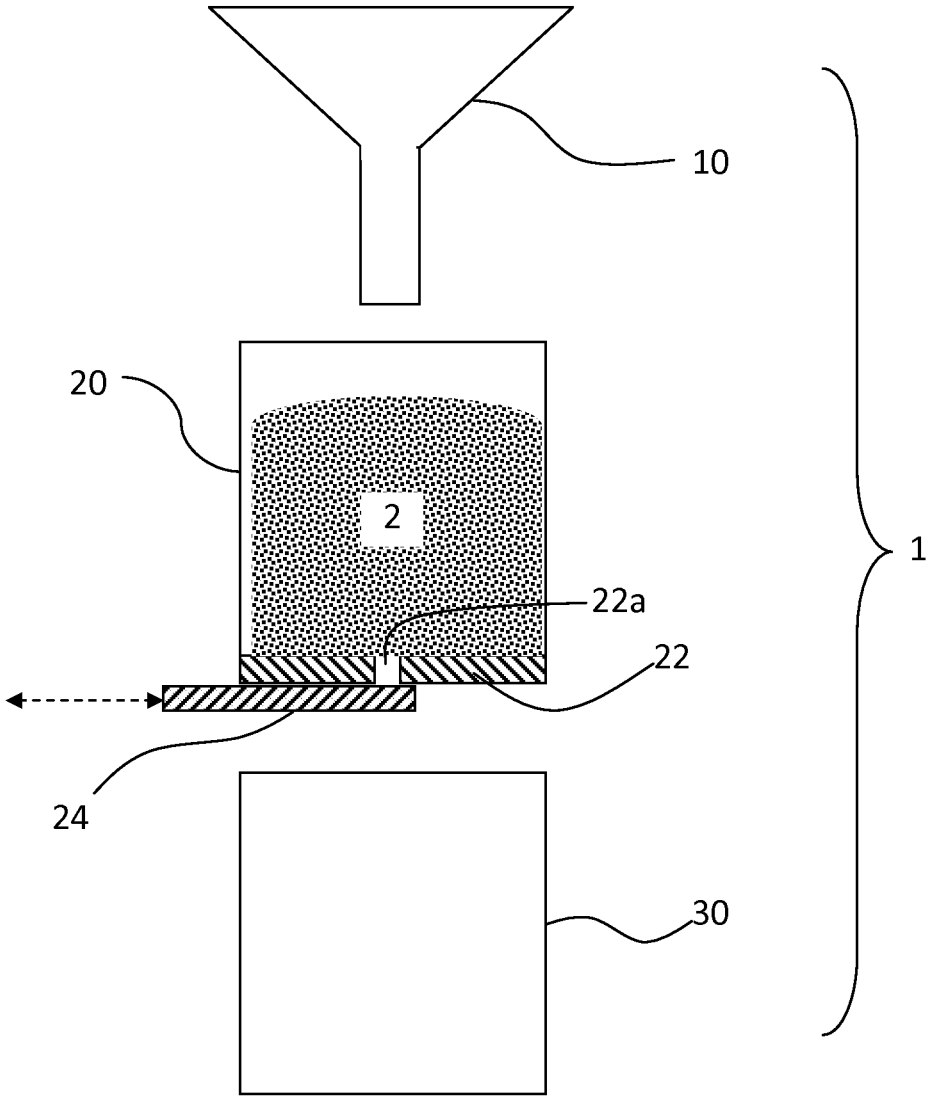
FIGS. 1 and 2 are cross-sectional diagrams illustrating how a FlowDex equipment can be used to measure flowability of polymer agglomerates formed according to the present invention.

As used herein, articles such as "a" and "an" when used in a claim, are understood to mean one or more of what is claimed or described. The terms "include", "includes" and "including" are meant to be non-limiting.

As used herein, the term "a granular detergent composition" refers to a solid composition, such as granular or powder-form all-purpose or heavy-duty washing agents for fabric, as well as cleaning auxiliaries such as bleach, rinse aids, additives, or pre-treat types.

The term "structured particle" as used herein refers to a particle with discrete particle shape and size, preferably an agglomerate particle.

The term "bulk density" as used herein refers to the uncompressed, untapped powder bulk density, as measured by the Bulk Density Test specified hereinafter.

The term "particle size distribution" as used herein refers to a list of values or a mathematical function that defines the relative amount, typically by mass or weight, of particles present according to size, as measured by the Sieve Test specified hereinafter.

As used herein, the term "substantially free" means that that the component of interest is present in an amount less than 0.5% by weight, and preferably less than 0.1% by weight.

In all embodiments of the present invention, all percentages or ratios are calculated by weight, unless specifically stated otherwise. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Structured Particles

The present invention relates to a structured particle that comprises an alkoxylated polyalkyleneimine, a water-soluble alkali metal carbonate, silica and optionally a water-soluble alkali metal sulfate.

Such structured particle is particularly characterized by a particle size distribution Dw50 of from about 250 microns to about 1000 microns, preferably from about 300 microns to about 800 microns, more preferably from about 400 microns to about 600 microns. The bulk density of such structured particles may range from 500 g/L to 1500 g/L, preferably from 600 g/L to 1000 g/L, more preferably from 700 g/L to 800 g/L.

The structured particle of the present invention has a total surfactant content of from 0 wt % to about 5 wt %, and preferably from 0 wt % to about 4 w %. The moisture content of such structured particle is preferably less than 4 wt %, more preferably less than 3 wt %, and most preferably less than 2 wt %.

Preferably, but not necessarily, the structured particle of the present invention contains little or no zeolite and/or phosphate. For example, it may contain from 0 wt % to about 5 wt %, preferably from 0 wt % to about 3 wt %, more preferably from 0 wt % to about 1 wt % and most preferably from 0 wt % to about 0.1 wt %, of zeolite. It may also contain from 0 wt % to about 5 wt %, more preferably from 0 wt % to about 3 wt %, and most preferably from 0 wt % to about 1 wt %, of phosphate.

All the above-described weight percentages in this section are calculated based on the total weight of the structured particle.

Alkoxylated Polyalkyleneimine

The alkoxylated polyalkyleneimine useful for practice of the present invention may contain a polyalkyleneimine backbone or core that is modified by replacing one or more hydrogen atoms attached to the nitrogen atoms in such backbone or core with polyoxyalkyleneoxy unit, i.e., —$(C_nH_{2n}O)_xH$, while n is an integer ranging from about 1 to about 10, preferably from about 1 to about 5, and more preferably from about 2 to about 4, and x is an integer ranging from 1 to 200, preferably from about 2 to about 100, and more preferably from about 5 to about 50. The polyalkyleneimine backbone or core typically has an average number-average molecular weight ($Mw_n$) prior to modification within the range of from about 100 to about 100,000, preferably from about 200 to about 5000, and more preferably from about 500 to about 1000. Suitable alkoxylated polyalkyleneimines are described by WO98/20102A and U.S. Pat. No. 8,097,579B.

More preferably, the alkoxylated polyalkyleneimine of the present invention has a polyethyleneimine core with inner polyethylene oxide blocks and outer polypropylene oxide blocks. Specifically, such alkoxylated polyalkyleneimine has an empirical formula of $(PEI)_a(CH_2CH_2O)_b(CH_2CH_2CH_2O)_c$, while PEI stands for a polyethyleneimine core, while a is the average number-average molecular weight ($Mw_n$) prior to modification within the range of from about 100 to about 100,000 Daltons; b is the weight average number of ethylene oxide ($CH_2CH_2O$) units per nitrogen atom in the PEI core, which is an integer ranging from about 0 to about 60; and c is the weight average number of propylene oxide ($CH_2CH_2CH_2O$) units per nitrogen atom in the PEI core, which is an integer ranging from about 0 to about 60. Preferably, a ranges from about 200 to about 5000 Daltons, and more preferably from about 500 to about 1000 Daltons; preferably b ranges from about 10 to about 50, and more preferably from about 20 to about 40; and preferably c ranges from about 0 to about 60, preferably from about 1 to about 20, and more preferably from about 2 to about 10. Please note that the empirical formula shows only the relative amounts of each of the constituents, and is not intended to indicate the structural order of the different moieties.

Selected embodiments of the alkoxylated polyalkyleneimine for use in the present invention as well as methods of making them are described in detail in U.S. Pat. Nos. 7,820,610, 8,097,579, and 8,247,368.

The alkoxylated polyalkyleneimine is present in the structured particles of the present invention in an amount ranging from about 10 wt % to about 50 wt %, preferably from about 20 wt % to about 40 wt %, and more preferably from about 25 wt % to about 35 wt %, by total weight of the structured particles.

Water-Soluble Alkali Metal Carbonate

The structured particles of the present invention may also contain a water-soluble alkali metal carbonate. Suitable alkali metal carbonate that can be used for practice of the present invention include, but are not limited to, sodium carbonate, potassium carbonate, sodium bicarbonate, and potassium bicarbonate (which are all referred to as "carbonates" or "carbonate" hereinafter). Sodium carbonate is particularly preferred. Potassium carbonate, sodium bicarbonate, and potassium bicarbonate can also be used.

The water-soluble alkali metal carbonate may be used in the structured particles at an amount ranging from about 20 wt % to about 70 wt %, preferably from 30 wt % to about 60 wt %, and preferably from about 40 wt % to about 50 wt %, measured by total weight of the structured particles.

The water-soluble alkali metal carbonate is in a particulate form and is preferably characterized by a particle size distribution Dw50 ranging from about 10 microns to about 100 microns, more preferably from about 50 microns to about 95 microns, and most preferably from about 70 microns to about 90 microns. Particle size of the carbonate may be reduced by a milling, grinding or a comminuting step down to a Dw50 range of from about 10 microns to about 35 microns, using any apparatus known in the art for milling, grinding or comminuting of granular or particulate compositions. In a particularly preferred embodiment of the present invention, the structured particles comprise sodium carbonate particles having Dw50 ranging from about 70 microns to about 90 microns in an amount ranging from about 40 wt % to about 60 wt %.

Silica

The structured particles of the present invention may also contain silica, which is preferably hydrophilic silica. Upon hydration, hydrophilic silica can form swollen hydrogel particles of significantly larger sizes, thereby facilitating faster dispersion and dissolution of the structured particles into the laundering liquor and promptly "activating" functionalities of the alkoxylated polyalkyleneimine.

The hydrophilic silica is preferably present in the structured particles in an amount ranging from about 1 wt % to about 20 wt %, more preferably from about 2 wt % to about 15 wt % and most preferably from about 3 wt % to about 5 wt % (if sulfate is present in the structured particle) or from about 10 wt % to about 15 wt % (if sulfate is not present).

The hydrophilic silica is provided in a dry powder form, which has relatively small dry particle size and low residue salt content. Specifically, the silica particles have a dry particle size distribution Dw50 ranging from about 0.1 μm to about 100 μm, preferably from about 1 μm to about 50 μm, more preferably from about 2 μm to about 40 μm, and most preferably from 3 μm to about 30 μm. The residual salt content in the hydrophilic silica is less than about 10%, preferably less than about 5%, more preferably less than about 2% or 1% by total weight of the silica. In a most preferred embodiment, the hydrophilic silica is substantially free of any residue salt.

Amorphous synthetic silica can be manufactured using a thermal or pyrogenic or a wet process. The thermal process leads to fumed silica. The wet process to either precipitated silica or silica gels. Either fumed silica or precipitated silica can be used for practice of the present invention. The pH of the hydrophilic silica of the present invention is normally from about 5.5 to about 9.5, preferably from about 6.0 to about 7.0. Surface area of the hydrophilic silica may range preferably from 100 to 500 $m^2/g$, more preferably from 125 to 300 $m^2/g$ and most preferably from 150 to 200 $m^2/g$, as measured by the BET nitrogen adsorption method.

Silica has both internal and external surface area, which allows for easy absorption of liquids. Hydrophilic silica is especially effective at adsorbing water. Swelling of dried hydrophilic silica upon contact with excess water to form hydrogel particles can be observed by optical microscopy and can be measured quantitatively using particle size analysis by comparing the particle size distribution of the fully hydrated material (i.e., in a dilute suspension) with that of the dried powder. Generally, precipitated hydrophilic silica can absorb water in excess of 2 times of its original weight, thereby forming swollen hydrogel particles having a Swollen Factor of at least 5, preferably at least 10, and more preferably at least 30. Therefore, the hydrophilic silica used in the present invention is preferably amorphous precipitated silica. A particularly preferred hydrophilic precipitated silica material for practice of the present invention is commercially available from Evonik Corporation under the tradename Sipernat®340.

In order to allow the silica particles to achieve maximum volumetric expansion upon hydration, it is preferred that the structured particles of the present invention contain little or no free water, e.g., preferably less than about 5%, more preferably less than about 4% and most preferably less than about 3% by total weight of such structured particles. In this manner, the external and internal surfaces of the silica particles are substantially free of water or liquids, and the silica particles are in a substantially dry state and are therefore capable of undergoing subsequent expansion in volume when they come into contact with water during washing cycle to facilitate disintegration of the structured particles and accelerate release of the alkoxylated polyalkyleneimine into water.

Upon hydration, i.e., when the structured particles of the present invention come into contact with water or other laundry liquor during a washing cycle, the hydrophilic silica as described hereinabove swells up significantly in volume to form swollen silica particles, which are characterized by a particle size distribution Dv50 of from 1 μm to 100 μm, preferably from 2 μm to 80 μm, more preferably from 3 μm to 70 μm, and most preferably from 5 μm to 50 μm. More specifically, the swollen silica particles formed by the hydrophilic silica upon hydration are characterized by a particle size distribution of Dv10 ranging from 1 μm to 30 μm, preferably from 2 μm to 15 μm, and more preferably from 4 μm to 10 μm; and Dv90 ranging from 20 μm to 100 μm, preferably from 30 μm to 80 μm, and more preferably from 40 μm to 60 μm.

Water-Soluble Alkali Metal Sulfate

The structured particles of the present invention can, but does have to, contain one or more water-soluble alkaline metal sulfates. The water-soluble alkaline metal sulfates can be selected from the group consisting of sodium sulfate, potassium sulfate, sodium bisulfate, potassium bisulfate, and the like. Sodium sulfate is particularly preferred.

The water-soluble alkali metal sulfate may be used in the structured particles at an amount ranging from 0 wt % to about 40 wt %, preferably from 0 wt % to about 35 wt %, and more preferably 0% or from about 15 wt % to about 30 wt %, measured by total weight of the structured particles.

The water-soluble alkali metal sulfate is in a particulate form and is preferably characterized by a particle size distribution Dw50 ranging from about 50 microns to about 250 microns, more preferably from about 80 microns to about 240 microns, and most preferably from about 180 microns to about 220 microns. In a particularly preferred embodiment of the present invention, the structured particles comprise sodium sulfate particles having Dw50 ranging from about 180 microns to about 220 microns in an amount ranging from about 15 wt % to about 25 wt %.

Other Ingredients

The structured particles of the present invention may comprise one or more organic solvents selected from the group consisting of alkylene glycols, glycol ethers, glycol ether esters, and combinations thereof. Such organic solvents are useful for solubilizing the amphiphilic graft polymer to form a polymeric solution that can be used as a binder during the agglomeration process. Therefore, the organic solvents are present in the structured particles in a relatively low amount, e.g., from about 0.1 wt % to about 5 wt %, preferably from about 0.5 wt % to about 3 wt %. Particularly preferred organic solvents include propylene glycol, dipropylene glycol, tripropylene glycol, tripropylene glycol n-butyl ether, and the like.

The structured particles may also contain, in small amounts (e.g., no more than 5 wt %), of other cleaning actives such as anionic surfactants, cationic surfactants, amphoteric surfactants, chelants, polymers, enzymes, colorants, bleaching agents, flocculation aids, and the like. However, in a preferred embodiment of the present invention, the structured particles are substantially free of other cleaning actives except those described in the preceding paragraphs.

Preferably but not necessarily, all of the above-described ingredients of the structured particles are mixed together in a mechanical mixer to form such structured particles by an agglomeration process.

Granular Detergent Composition

The above-described structured particles are particularly useful for forming granular detergent compositions. Such structured particles may be provided in a granular detergent composition in an amount ranging from 1% to 10%, preferably from 2% to 8%, and more preferably from 3% to 7% by total weight of the granular detergent composition.

The granular detergent composition may comprise one or more surfactants selected from the group consisting of anionic surfactants, cationic surfactants, nonionic surfactants, amphoteric surfactants, and mixtures thereof. Such granular detergent composition may contain only one type of anionic surfactant. It may also contain a combination of two or more different anionic surfactants, a combination of one or more anionic surfactants with one or more nonionic surfactants, a combination of one or more anionic surfactants with one or more cationic surfactants, or a combination of all three types of surfactants (i.e., anionic, nonionic, and cationic).

Anionic surfactants suitable for forming the granular detergent compositions of the present invention can be readily selected from the group consisting of $C_{10}$-$C_{20}$ linear or branched alkyl alkoxylated sulphates, $C_{10}$-$C_{20}$ linear or branched alkyl benzene sulphonates, $C_{10}$-$C_{20}$ linear or branched alkyl sulfates, $C_{10}$-$C_{20}$ linear or branched alkyl sulphonates, $C_{10}$-$C_{20}$ linear or branched alkyl phosphates, $C_{10}$-$C_{20}$ linear or branched alkyl phosphonates, $C_{10}$-$C_{20}$ linear or branched alkyl carboxylates, and salts and mixtures thereof. The total amount of anionic surfactants in the granular laundry detergent compositions may range from 5% to 95%, preferably from 10% to 70%, more preferably from 15% to 55%, and most preferably from 20% to 50%, by total weight of such compositions.

The granular laundry detergent compositions of the present invention may comprise a cationic surfactant. When present, the composition typically comprises from about 0.05 wt % to about 5 wt %, or from about 0.1 wt % to about 2 wt % of such cationic surfactant. Suitable cationic surfactants are alkyl pyridinium compounds, alkyl quaternary ammonium compounds, alkyl quaternary phosphonium compounds, and alkyl ternary sulfonium compounds. The cationic surfactant can be selected from the group consisting of: alkoxylate quaternary ammonium (AQA) surfactants; dimethyl hydroxyethyl quaternary ammonium surfactants; polyamine cationic surfactants; cationic ester surfactants; amino surfactants, specifically amido propyldimethyl amine; and mixtures thereof. Highly preferred cationic surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride. Cationic surfactants such as Praepagen HY (tradename Clariant) may be useful and may also be useful as a suds booster.

The granular laundry detergent compositions of the present invention may comprise one or more non-ionic surfactants in amounts of from about 0.5 wt % to about 20 wt %, and preferably from 2 wt % to about 4 wt % by total weight of the compositions. Suitable non-ionic surfactants can be selected from the group consisting of: alkyl polyglucoside; $C_8$-$C_{16}$ alkyl alkoxylated alcohols; $C_8$-$C_{16}$ alkyl alkoxylates, such as, NEODOL® non-ionic surfactants from Shell; $C_8$-$C_{16}$ alkyl phenol alkoxylates wherein the alkoxylate units are ethyleneoxy units, propyleneoxy units or a mixture thereof; $C_8$-$C_{16}$ alcohol and $C_8$-$C_{16}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 35; alkylcelluloses, specifically alkylpolyglycosides; polyhydroxy fatty acid amides; ether capped poly(oxyalkylated) alcohol surfactants; and mixtures thereof. A particularly preferred nonionic surfactant is a $C_8$-$C_{16}$ alkyl alkoxylated alcohol or a $C_8$-$C_{16}$ alkyl alkoxylate.

The granular detergent compositions may optionally include one or more other detergent adjunct materials for assisting or enhancing cleaning performance, treatment of the substrate to be cleaned, or to modify the aesthetics of the detergent composition. Illustrative examples of such detergent adjunct materials include: (1) inorganic and/or organic builders, such as carbonates (including bicarbonates and sesquicarbonates), sulphates, phosphates (exemplified by the tripolyphosphates, pyrophosphates, and glassy polymeric meta-phosphates), phosphonates, phytic acid, silicates, zeolite, citrates, polycarboxylates and salts thereof (such as mellitic acid, succinic acid, oxydisuccinic acid, polymaleic acid, benzene 1,3,5-tricarboxylic acid, carboxymethyloxysuccinic acid, and soluble salts thereof), ether hydroxypolycarboxylates, copolymers of maleic anhydride with ethylene or vinyl methyl ether, 1,3,5-trihydroxy benzene-2,4,6-trisulphonic acid, 3,3-dicarboxy-4-oxa-1,6-hexanedioates, polyacetic acids (such as ethylenediamine tetraacetic acid and nitrilotriacetic acid) and salts thereof, fatty acids (such as $C_{12}$-$C_{18}$ monocarboxylic acids); (2) chelating agents, such as iron and/or manganese-chelating agents selected from the group consisting of amino carboxylates, amino phosphonates, polyfunctionally-substituted aromatic chelating agents and mixtures therein; (3) clay soil removal/anti-redeposition agents, such as water-soluble ethoxylated amines (particularly ethoxylated tetraethylenepentamine); (4) polymeric dispersing agents, such as polymeric polycarboxylates and polyethylene glycols, acrylic/maleic-based copolymers and water-soluble salts thereof of, hydroxypropylacrylate, maleic/acrylic/vinyl alcohol terpolymers, polyethylene glycol (PEG), polyaspartates and polyglutamates; (5) optical brighteners, which include but are not limited to derivatives of stilbene, pyrazoline, coumarin, carboxylic acid, methinecyanines, dibenzothiphene-5,5-dioxide, azoles, 5- and 6-membered-ring heterocycles, and the like; (6) suds suppressors, such as monocarboxylic fatty acids and soluble salts thereof, high molecular weight hydrocarbons (e.g., paraffins, haloparaffins, fatty acid esters, fatty acid esters of monovalent alcohols, aliphatic $C_{18}$-$C_{40}$ ketones, etc.), N-alkylated amino triazines, propylene oxide, monostearyl phosphates, silicones or derivatives thereof, secondary alcohols (e.g., 2-alkyl alkanols) and mixtures of such alcohols with silicone oils; (7) suds boosters, such as $C_{10}$-$C_{16}$ alkanolamides, $C_{10}$-$C_{14}$ monoethanol and diethanol amides, high sudsing surfactants (e.g., amine oxides, betaines and sultaines), and soluble magnesium salts (e.g., $MgCl_2$, $MgSO_4$, and the like); (8) fabric softeners, such as smectite clays, amine softeners and cationic softeners; (9) dye transfer inhibiting agents, such as polyvinyl pyrrolidone polymers, polyamine N-oxide polymers, copolymers of N-vinylpyrrolidone and N-vinylimidazole, manganese phthalocyanine, peroxidases, and mixtures thereof; (10) enzymes, such as proteases, amylases, lipases, cellulases, and peroxidases, and mixtures thereof; (11) enzyme stabilizers, which include water-soluble sources of calcium and/or magnesium ions, boric acid or borates (such as boric oxide, borax and other alkali metal borates); (12) bleaching agents, such as percarbonates (e.g., sodium carbonate peroxyhydrate, sodium pyrophosphate peroxyhydrate, urea peroxyhydrate, and sodium peroxide), persulfates, perborates, magnesium monoperoxyphthalate hexahydrate, the magnesium salt of metachloro perbenzoic acid, 4-nonylamino-4-oxoperoxybutyric acid and diperoxydodecanedioic acid, 6-nonylamino-6-oxoperoxycaproic acid, and photoactivated bleaching agents (e.g., sulfonated zinc and/or aluminum phthalocyanines); (13) bleach activators, such as nonanoyloxybenzene sulfonate (NOBS), tetraacetyl ethylene diamine (TAED), amido-derived bleach activators including (6-octanamidocaproyl)oxybenzenesulfonate, (6-nonanamidocaproyl)oxybenzenesulfonate, (6-decanamidocaproyl) oxybenzenesulfonate, and mixtures thereof, benzoxazin-type activators, acyl lactam activators (especially acyl caprolactams and acyl valerolactams); and (9) any other known detergent adjunct ingredients, including but not limited to carriers, hydrotropes, processing aids, dyes or pigments, and solid fillers.

In a preferred but not necessary embodiment of the present invention, the granular laundry detergent composition contains from about 0 wt % to about 1 wt % of a silicone-containing particle for foam or suds control. Such silicone-containing particle is typically formed by mixing or combining a silicone-derived anti-foaming agent with a particulate carrier material.

The silicone-derived anti-foaming agent can be any suitable organosilicones, including, but not limited to: (a) non-functionalized silicones such as polydimethylsiloxane (PDMS); and (b) functionalized silicones such as silicones with one or more functional groups selected from the group consisting of amino, amido, alkoxy, alkyl, phenyl, polyether, acrylate, siliconehydride, mercaptoproyl, carboxylate, sulphate phosphate, quaternized nitrogen, and combinations thereof. In typical embodiments, the organosilicones suitable for use herein have a viscosity ranging from about 10 to about 700,000 CSt (centistokes) at 20° C. In other embodiments, the suitable organosilicones have a viscosity from about 10 to about 100,000 CSt.

Polydimethylsiloxanes (PDMS) can be linear, branched, cyclic, grafted or cross-linked or cyclic structures. In some embodiments, the detergent compositions comprise PDMS having a viscosity of from about 100 to about 700,000 CSt at 20° C.

Exemplary functionalized silicones include but are not limited to aminosilicones, amidosilicones, silicone polyethers, alkylsilicones, phenyl silicones and quaternary silicones. The functionalized silicones suitable for use in the present invention have the following general formula:

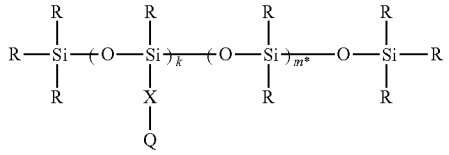

wherein m is from 4 to 50,000, preferably from 10 to 20,000; k is from 1 to 25,000, preferably from 3 to 12,000; each R is H or C1-C8 alkyl or aryl group, preferably C1-C4 alkyl, and more preferably a methyl group.

X is a linking group having the formula:

(i) —(CH2)p-, wherein p is from 2 to 6, preferably 2 to 3;

ii)

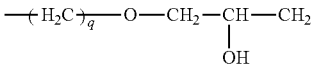

wherein q is from 0 to 4, preferably 1 to 2; or (iii)

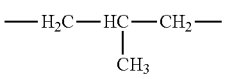

Q has the formula:

(i) —NH2, —NH—(CH2)r-NH2, wherein r is from 1 to 4, preferably 2 to 3; or (ii) —(O—CHR2-CH2)s-Z, wherein s is from 1 to 100, preferably 3 to 30;

wherein R2 is H or C1-C3 alkyl, preferably H or CH3; and Z is selected from the group consisting of —OR3, —OC(O)R3, –CO—R4-COOH, —$SO_3$, —PO(OH)2, and mixtures thereof; further wherein R3 is H, C1-C26 alkyl or substituted alkyl, C6-C26 aryl or substituted aryl, C7-C26 alkylaryl or substituted alkylaryl groups, preferably R3 is H, methyl, ethyl propyl or benzyl groups; R4 is —CH2- or —CH2CH2- groups; and (iii)

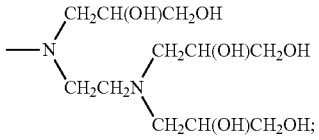

(iv)

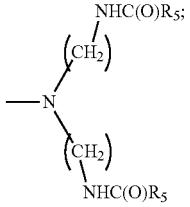

wherein each n is independently from 1 to 4, preferably 2 to 3; and R.sub.5 is C1-C4 alkyl, preferably methyl.

Another class of preferred organosilicone comprises modified polyalkylene oxide polysiloxanes of the general formula:

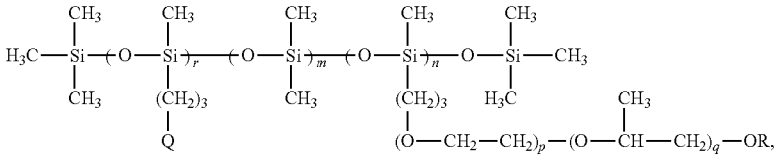

wherein Q is NH2 or —NHCH2CH2NH2; R is H or C1-C6 alkyl; r is from 0 to 1000; m is from 4 to 40,000; n is from 3 to 35,000; and p and q are integers independently selected from 2 to 30.

When r is 0, non-limiting examples of such polysiloxanes with polyalkylene oxide are Silwet® L-7622, Silwet® L-7602, Silwet® L-7604, Silwet® L-7500, Magnasoft® TLC, available from GE Silicones of Wilton, Conn.; Ultrasil® SW-12 and Ultrasil® DW-18 silicones, available from Noveon Inc., of Cleveland, Ohio; and DC-5097, FF-400® available from Dow Corning of Midland, Mich. Additional examples are KF-352®, KF-6015®, and KF-945®, all available from Shin Etsu Silicones of Tokyo, Japan.

When r is 1 to 1000, non-limiting examples of this class of organosilicones are Ultrasil® A21 and Ultrasil® A-23, both available from Noveon, Inc. of Cleveland, Ohio; BY16-876® from Dow Corning Toray Ltd., Japan; and X22-3939A® from Shin Etsu Corporation, Tokyo Japan.

A third class of preferred organosilicones comprises modified polyalkylene oxide polysiloxanes of the general formula:

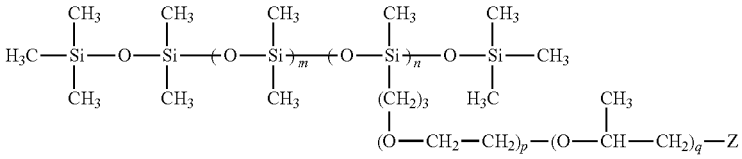

wherein m is from 4 to 40,000; n is from 3 to 35,000; and p and q are integers independently selected from 2 to 30.

Z is selected from:

(i) —C(O)—R7, wherein R7 is C1-C24 alkyl group;

(ii) —C(O)—R4-C(O)—OH, wherein R4 is CH2 or CH2CH2;

(iii) —SO3;

(iv) —P(O)OH2;

(v)

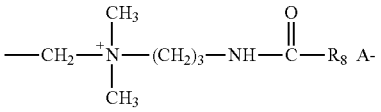

wherein R8 is C1-C22 alkyl and A- is an appropriate anion, preferably $Cl^-$;

(vi)

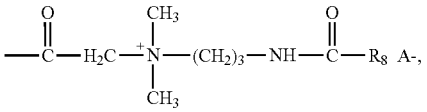

wherein R8 is C1-C22 alkyl and A- is an appropriate anion, preferably $Cl^-$.

Another class of preferred silicones comprises cationic silicones. These are typically produced by reacting a diamine with an epoxide. They are described in WO 02/18528 and WO 04/041983 (both assigned to P&G), WO 04/056908 (assigned to Wacker Chemie) and U.S. Pat. No. 5,981,681 and U.S. Pat. No. 5,807,956 (assigned to OSi Specialties). These are commercially available under the trade names Magnasoft® Prime, Magnasoft® HSSD, Silsoft® A-858 (all from GE Silicones) and Wacker SLM21200®.

Organosilicone emulsions, which comprise organosilicones dispersed in a suitable carrier (typically water) in the presence of an emulsifier (typically an anionic surfactant), can also be used as the anti-foaming agent in the present invention. In another embodiment, the organosilicones are in the form of microemulsions. The organosilicone microemulsions may have an average particle size in the range from about 1 nm to about 150 nm, or from about 10 nm to about 100 nm, or from about 20 nm to about 50 nm. Microemulsions are more stable than conventional macroemulsions (average particle size about 1-20 microns) and when incorporated into a product, the resulting product has a preferred clear appearance. More importantly, when the composition is used in a typical aqueous wash environment, the emulsifiers in the composition become diluted such that the microemulsions can no longer be maintained and the organosilicones coalesce to form significantly larger droplets which have an average particle size of greater than about 1 micron.

Suitable particulate carrier materials that can be used in forming the silicone-containing particles described hereinabove include, but are not limited to: silica, zeolite, bentonite, clay, ammonium silicates, phosphates, perborates, polymers (preferably cationic polymers), polysaccharides, polypeptides, waxes, and the like.

In a preferred but not necessary embodiment of the present invention, the silicone-containing particle used herein contains a polydimethylsiloxane or polydiorganosiloxane polymer, hydrophobic silica particles, a polycarboxylate copolymer binder, an organic surfactant, and a zeolite carrier. Suitable silicone-containing particles that are commercially available include those under the tradename Dow Corning® Antifoam from Dow Corning Corporation (Midland, Minn.).

Process for Making Structured Particles

The process of making the structured particles of the present invention, preferably in an agglomerated form, comprising the steps of: (a) providing the raw materials in the weight proportions as defined hereinabove, in either powder and/or paste forms; (b) mixing the raw materials in a mixer or granulator that is operating at a suitable shear force for agglomeration of the raw materials; (c) optionally, removing any oversize particles, which are recycled via a grinder or lump-breaker back into the process stream, e.g., into step (a) or (b); (d) the resulting agglomerates are dried to remove moisture that may be present in excess of 3 wt %, preferably in excess of 2%, and more preferably in excess of 1%; (e) optionally, removing any fines and recycling the fines to the mixer-granulator, as described in step (b); and (f) optionally, further removing any dried oversize agglomerates and recycling via a grinder to step (a) or (e).

Any suitable mixing apparatus capable of handling viscous paste can be used as the mixer described hereinabove for practice of the present invention. Suitable apparatus includes, for example, high-speed pin mixers, ploughshare mixers, paddle mixers, twin-screw extruders, Teledyne compounders, etc. The mixing process can either be carried out intermittently in batches or continuously.

Process for Making the Granular Detergent Compositions Comprising the Structured Particles The granular detergent composition, which is provided in a finished product form, can be made by mixing the structured particles of the present invention with a plurality of other particles containing the above-described surfactants and adjunct materials. Such other particles can be provided as spray-dried particles, agglomerated particles, and extruded particles. Further, the surfactants and adjunct materials can also be incorporated into the granular detergent composition in liquid form through a spray-on process.

Process for Using the Granular Detergent Compositions for Washing Fabric

The granular detergent compositions of the present invention are suitable for use in both a machine-washing or a hand-washing context. The laundry detergent is typically diluted by a factor of from about 1:100 to about 1:1000, or about 1:200 to about 1:500 by weight. The wash water used to form the laundry liquor is typically whatever water is easily available, such as tap water, river water, well water, etc. The temperature of the wash water may range from about 0° C. to about 40° C., preferably from about 5° C. to about 30° C., more preferably from 5° C. to 25° C., and most preferably from about 10° C. to 20° C., although higher temperatures may be used for soaking and/or pretreating.

Test Methods

The following techniques must be used to determine the properties of the detergent granules and detergent compositions of the invention in order that the invention described and claimed herein may be fully understood.

Test 1: Bulk Density Test

The granular material bulk density is determined in accordance with Test Method B, Loose-fill Density of Granular Materials, contained in ASTM Standard E727-02, "Standard Test Methods for Determining Bulk Density of Granular Carriers and Granular Pesticides," approved Oct. 10, 2002.

Test 2: Sieve Test

This test method is used herein to determine the particle size distribution of the structured particles or the detergent granules of the present invention. The particle size distribution of the structured particles or the detergent granules are measured by sieving the particles granules through a succession of sieves with gradually smaller dimensions. The weight of material retained on each sieve is then used to calculate a particle size distribution.

This test is conducted to determine the Median Particle Size of the subject particle using ASTM D 502-89, "Standard Test Method for Particle Size of Soaps and Other Detergents", approved May 26, 1989, with a further specification for sieve sizes used in the analysis. Following section 7, "Procedure using machine-sieving method," a nest of clean dry sieves containing U.S. Standard (ASTM E 11) sieves #8 (2360 μm), #12 (1700 μm), #16 (1180 μm), #20 (850 μm), #30 (600 μm), #40 (425 μm), #50 (300 μm), #70 (212 μm), and #100 (150 μm) is required. The prescribed Machine-Sieving Method is used with the above sieve nest. The detergent granule of interest is used as the sample. A suitable sieve-shaking machine can be obtained from W.S. Tyler Company of Mentor, Ohio, U.S.A. The data are plotted on a semi-log plot with the micron size opening of each sieve plotted against the logarithmic abscissa and the cumulative mass percent (Q3) plotted against the linear ordinate.

An example of the above data representation is given in ISO 9276-1:1998, "Representation of results of particle size analysis—Part 1: Graphical Representation", Figure A.4. The Median Weight Particle Size (Dw50) is defined as the abscissa value at the point where the cumulative weight percent is equal to 50 percent, and is calculated by a straight line interpolation between the data points directly above (a50) and below (b50) the 50% value using the following equation:

$$D_w50=10[\mathrm{Log}(D_{a50})-(\mathrm{Log}(D_{a50})-\mathrm{Log}(D_{b50}))*(Q_{a50}-50\%)/(Q_{a50}-Q_{b50})]$$

where $Q_{a50}$ and $Q_{b50}$ are the cumulative weight percentile values of the data immediately above and below the $50^{th}$ percentile, respectively; and $D_{a50}$ and $D_{b50}$ are the micron sieve size values corresponding to these data. In the event that the $50^{th}$ percentile value falls below the finest sieve size (150 μm) or above the coarsest sieve size (2360 μm), then additional sieves must be added to the nest following a geometric progression of not greater than 1.5, until the median falls between two measured sieve sizes.

Test 3: Laser Diffraction Method

This test method must be used to determine a fine powder's (e.g. raw materials like sodium carbonate, silica and sodium sulfate) Weight Median Particle Size (Dw50). The fine powder's Weight Median Particle Size (Dw50) is determined in accordance with ISO 8130-13, "Coating powders—Part 13: Particle size analysis by laser diffraction." A suitable laser diffraction particle size analyzer with a dry-powder feeder can be obtained from Horiba Instruments Incorporated of Irvine, Calif., U.S.A.; Malvern Instruments Ltd of Worcestershire, UK; Sympatec GmbH of Clausthal-Zellerfeld, Germany; and Beckman-Coulter Incorporated of Fullerton, Calif., U.S.A.

The results are expressed in accordance with ISO 9276-1:1998, "Representation of results of particle size analysis—Part 1: Graphical Representation", Figure A.4, "Cumulative distribution Q3 plotted on graph paper with a logarithmic abscissa." The Median Particle Size is defined as the abscissa value at the point where the cumulative distribution (Q3) is equal to 50 percent.

Test 4: Silica Particle Size and Swollen Factor Test

The Swollen Factor Test is used to measure swelling of hydrophilic silica on contact with excess water. As a measure of swelling, this method compares the measured particle size distribution of silica hydrated in excess water relative to the measured particle size distribution of the dry silica powder.

Obtain a representative dry powder sample of the silica raw material to be tested.

Measure the dry powder's particle size distribution in accordance with ISO 8130-13, "Coating powders—Part 13: Particle size analysis by laser diffraction." A suitable laser diffraction particle size analyzer with a dry-powder feeder can be obtained from Horiba Instruments Incorporated of Irvine, Calif., U.S.A.; Malvern Instruments Ltd of Worcestershire, UK; Sympatec GmbH of Clausthal-Zellerfeld, Germany; and Beckman-Coulter Incorporated of Fullerton, Calif., U.S.A. The results are expressed in accordance with ISO 9276-1:1998, "Representation of results of particle size analysis—Part 1: Graphical Representation", Figure A.4, "Cumulative distribution Q3 plotted on graph paper with a logarithmic abscissa." The Dv10 dry particle size (D10dry) is defined as the abscissa value at the point where the cumulative volumetric distribution (Q3) is equal to 10 percent; the Dv50 dry particle size (D50dry) is defined as the abscissa value at the point where the cumulative volumetric distribution (Q3) is equal to 50 percent; the Dv90 dry particle size (D90dry) is defined as the abscissa value at the point where the cumulative volumetric distribution (Q3) is equal to 90 percent.

Prepare a hydrated silica particle sample by weighing 0.05 g of the representative dry powder sample, and adding it into stirred beaker having 800 ml of deionized water. Using the resultant dispersion of silica hydrogel particles, measure the silica hydrogel's particle size distribution in accordance with ISO 13320-1, "Particle size analysis—Laser diffraction methods." Suitable laser diffraction particle size analyzers for measurement of the silica hydrogel particle size distribution can be obtained from Horiba Instruments Incorporated of Irvine, Calif., U.S.A.; Malvern Instruments Ltd of Worcestershire, UK; and Beckman-Coulter Incorporated of Fullerton, Calif., U.S.A. The results are expressed in accordance with ISO 9276-1:1998, "Representation of results of particle size analysis—Part 1: Graphical Representation", Figure A.4, "Cumulative distribution Q3 plotted on graph paper with a logarithmic abscissa." The Dv10 hydrogel particle size (D10hydro) is defined as the abscissa value at the point where the cumulative volume distribution (Q3) is equal to 10 percent; the Dv50 hydrogel particle size (D50hydro) is defined as the abscissa value at the point where the cumulative volume distribution (Q3) is equal to 50 percent; the Dv90 hydrogel particle size (D90hydro) is defined as the abscissa value at the point where the cumulative volume distribution (Q3) is equal to 90 percent.

The silica's Swollen Factor is calculated as follows:

$$\text{Swollen Factor}=0.2\times(D10_{hydro}/D10_{dry})^3+0.6\times(D50_{hydro}/D50_{dry})^3+0.2\times(D90_{hydro}/D90_{dry})^3$$

The Dv particle sizes for this example are shown in Table I.

TABLE I

| | Particle size (um) | | |
|---|---|---|---|
| | D10 | D50 | D90 |
| Dry silica particles | 2.08 | 5.82 | 21.01 |
| Silica in water (hydrogel) | 6.75 | 18.57 | 53.7 |

The Swollen Factor for the exemplary silica material described hereinabove, as calculated using the data from Table I, is about 30.

Test 5: Method for Measuring Cake Strength

A smooth plastic cylinder of internal diameter 6.35 cm and length 15.9 cm is supported on a suitable base plate. A 0.65 cm hole is drilled through the cylinder with the centre of the hole being 9.2 cm from the end opposite to the base plate.

A metal pin is inserted through the hole and a smooth plastic sleeve of internal diameter 6.35 cm and length 15.25 cm is placed around the inner cylinder such that the sleeve can move freely up and down the cylinder and comes to rest on the metal pin. The space inside the sleeve is then filled (without tapping or excessive vibration) with the testing powder such that the testing powder is level with the top of the sleeve. A lid is placed on top of the sleeve and a 5 kg weight is placed on the lid. The pin is then pulled out and the testing powder is allowed to compact for 5 minutes. After 5 minutes the weight is removed, the sleeve is lowered to expose the powder cake with the lid remaining on top of the powder.

A metal probe is then lowered at 54 cm/min such that it contacts the centre of the lid and breaks the cake. The maximum force required to break the cake is recorded as the cake strength of the sample. Cake strength of 0 N indicates that no cake is formed.

EXAMPLES

Example 1

Showing Cake Strength Improvement of Structured Particles of the Present Invention The following comparative test is carried out to demonstrate the cake strength of an Inventive Sample formed by Inventive polymer particle.

1.1. An Inventive particle A is made by agglomerating 80 grams alkoxylated polyalkyleneimine polymer which is controlled at 50° C. together with: (1) 12 grams of precipitated hydrophilic silica powder (commercialized by Evonik Industries AG under the 10 trade name SN340) that has a particle size distribution Dw50 of about 5.8 um; (2) 188 grams sodium carbonate that has a particle size distribution Dw50 of about 80 um; (3) 120 grams sodium sulfate that has a particle size distribution Dw50 of about 200 um in a BRAUN CombiMax K600 food mixer at the speed of class 8. The 80 grams polymer is injected into the food mixer at the speed of approximately 16 grams per second. The mixer is stopped 2 second after all of the polymer paste has been added. Thus 400 grams of Inventive particle A are formed.

1.2. The final composition breakdown of the Inventive Particle A is tabulated in Table I below.

TABLE I

| Inventive Particle A Composition | Wt % |
|---|---|
| Alkoxylated Polyalkyleneimine Polymer | 20.000% |
| Sodium Carbonate | 47.000% |
| Sodium Sulfate | 30.000% |
| Silica | 2.835% |
| Water | 0.165% |
| Total | 100.000% |

1.3. A base detergent particle B is formed by agglomerating 250.10 grams of linear alkylbenzene sulphonic acid (HLAS), which is 97% active, with 700.80 grams of sodium carbonate (same as that used in 1.1) and 49.1 grams of sodium carboxymethyl cellulose (CMC). The HLAS is neutralized with sodium carbonate and about 18.1 grams of carbon dioxide are generated. As a result, about 981.9 grams of the base detergent particle B is formed.

1.4. The final composition breakdowns of the base detergent particle B is tabulated in Table II below:

TABLE II

| Base Detergent Particle B Composition | Wt % |
|---|---|
| Linear alkylbenzene sulphonate | 26.13% |
| Sodium Carbonate | 66.92% |
| Carboxy methyl cellulose Sodium | 2.53% |
| Water&Misc. | 4.42% |
| Total | 100.00% |

1.5. An Inventive Laundry Detergent Sample I is formed by mixing 75 grams of the Inventive Particle A described in 1.1 with: (1) 400 grams of the base detergent particle B described in 1.3; (2) 525 grams of sodium sulfate same as that used in 1.1 in a Aichi TYPE RM-10-3 Rocking Mixer for 5 mins. As a result, about 1000 grams of Inventive Laundry Detergent Sample I is formed.

1.6. A Comparative Laundry Detergent Sample II is formed by mixing 400 grams of the base detergent particle B described in 1.3 with: (1) 2.25 grams silica (same as that used in 1.1); (2) 35.25 grams of sodium carbonate (same as that used in 1.1); and (3) 550 grams of sodium sulfate same as used in 1.1 in the same rocking mixer (as used in 1.5), onto which 15 grams of polymer paste (same as that used in 1.1) controlled at 50° C. is sprayed by a spray gun at a speed of approximately 3.75 grams per min. Finally, about 1000 grams of Comparative Laundry Detergent Sample II are formed.

1.7. The recipes for making Inventive Laundry Detergent Sample I and Comparative Laundry Detergent Sample II are tabulated in Table III.

TABLE III

| Recipes | Inventive Laundry Detergent Sample I | Comparative Laundry Detergent Sample II |
|---|---|---|
| Inventive Particle A | 7.50% | — |
| Base Detergent Particle B | 40% | 40% |
| Alkoxylated Polyalkyleneimine Polymer (Sprayed-on) | | 1.50% |
| Silica | — | 0.225% |
| Sodium Carbonate | — | 3.525% |
| Sodium Sulfate | 52.50% | 55% |
| Total | 100% | 100% |

1.8. The final composition breakdowns of the above-mentioned Inventive Laundry Detergent Sample I and Comparative Laundry Detergent Sample II are tabulated in Table IV.

TABLE IV

| Final Composition Breakdown | Inventive Laundry Detergent Sample I | Comparative Laundry Detergent Sample II |
|---|---|---|
| Linear alkylbenzene sulphonate | 10.45% | 10.45% |
| Alkoxylated Polyalkyleneimine Polymer | 1.50% | 1.50% |
| Silica | 0.21% | 0.21% |
| Sodium Carbonate | 30.29% | 30.29% |
| Sodium Sulfate | 54.75% | 55.00% |
| Sodium Carboxymethyl Cellulose | 1.01% | 1.01% |
| Water & Misc. | 1.78% | 1.53% |
| Total | 100% | 100% |

1.9. Respective cake strength of above-mentioned laundry detergent samples is measured according to the test method described hereinabove for measuring cake strength. The cake strength results are tabulated in Table V below:

TABLE V

| | Inventive Laundry Detergent Sample I | Comparative Laundry Detergent Sample II |
|---|---|---|
| Cake Strength/N | 4.80 | 10.29 |

Conclusion:

The results above show that the Inventive Laundry Detergent Sample I containing Inventive Particle A of the present invention has a relatively low cake strength, in comparison with the Comparative Laundry Detergent Sample II which is made by spraying alkoxylated polyalkyleneimine polymer onto base detergent granules. This indicates that the structured particle of the present invention containing the alkoxylated polyalkyleneimine polymer can be used to improve the cake strength of finished laundry detergent products.

Example 2

Showing Flowability Improvement of Structured Particles of the Present Invention 2.1. The Inventive Laundry Detergent Sample I and Comparative Laundry Detergent Sample II as described in Example 1 are tested for their respective flowability.

2.2. The device adapted for this test is a commercially available flowability testing system, Flodex™ (Hanson Research, Chatsworth, Calif., USA), which contains a flat-bottom cylindrical hopper with a removable bottom and a set of interchangeable bottom disks containing therein orifices of different sizes. Further, additional bottom disks with orifices of smaller sizes (with diameters below 4 mm) are made so as to provide a more complete range of orifice diameters including 3.0 mm, 3.5 mm, 4.0 mm, 5.0 mm, 6.0 mm, 7.0 mm, 8.0 mm, 9.0 mm, 10.0 mm, 12.0 mm, 14.0 mm.

Figure 2:
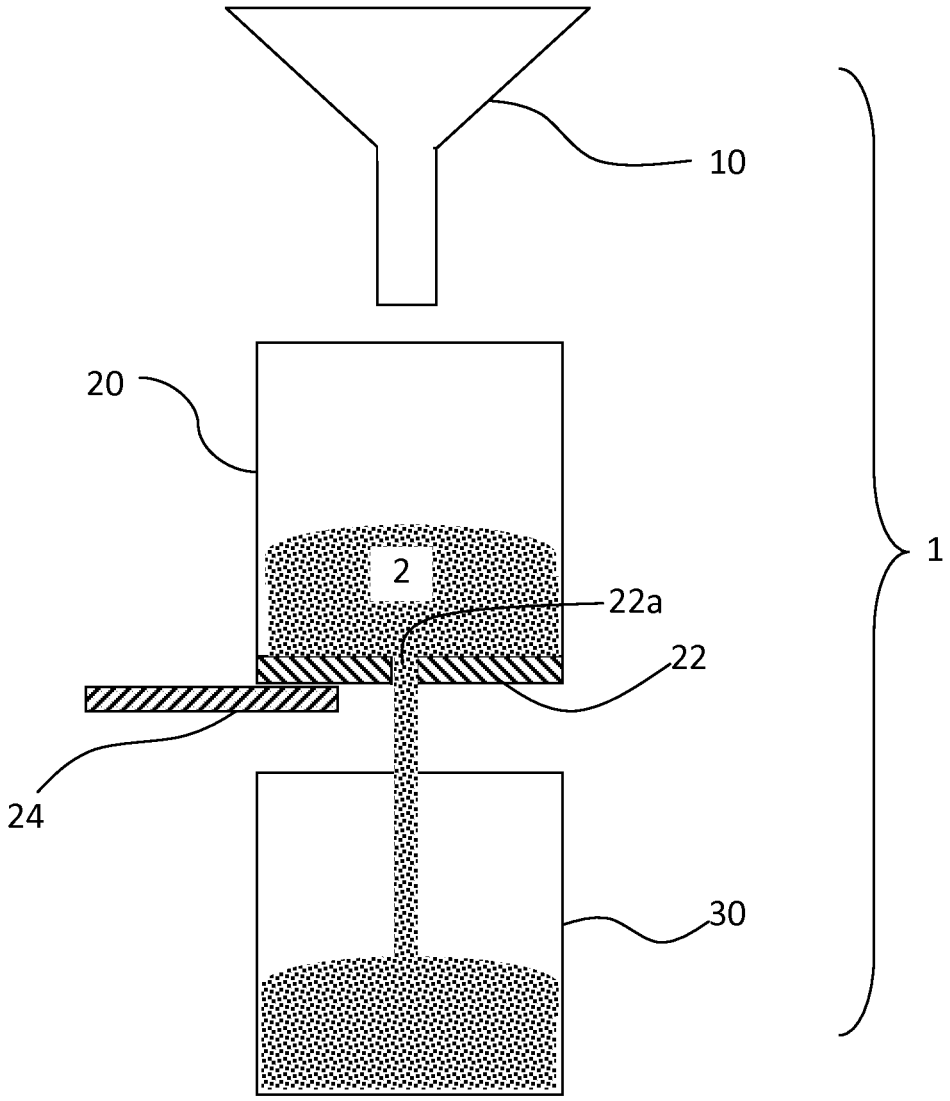

2.3. FIGS. 1 and 2 are cross-sectional diagrams illustrating how the FloDex equipment functions to carry out the flowability measurement. Specifically, the FloDex equipment 1 includes a funnel 10 for loading a particulate test sample 2 into a stainless steel flat-bottom cylindrical hopper 20 having a diameter of about 5.7 cm. The hopper 20 has a removable bottom defined by a removal bottom disk 22 with an orifice 22*a* of a specific size therein. Multiple removal bottom disks (not shown) having orifices of different sizes are provided, as mentioned hereinabove, which can be interchangeably fit at the bottom of hopper 20 in place of disk 22 to thereby define a bottom orifice of a different size from 22*a*. A discharge gate 24 is placed immediately underneath the orifice 22*a* and above a receiver 30, as shown in FIG. 1. When the flowability measurement starts, the discharge gate 24 is moved so as to expose the bottom orifice 22*a* and allow the particulate test sample 2 to flow from the hopper 20 through the bottom orifice 22*a* down to the receiver 30, as shown in FIG. 2.

2.4. To test the flowability of a specific test sample, the following steps are followed:

a. Fill the hopper 20 by pouring about 125 ml of the test sample through funnel 10. The sample fills the 5.7 cm-diameter hopper 20 to a height of about 5 cm.

b. After the sample settles, open the spring-loaded discharge gate 24 and allow the sample to flow through the orifice 22*a* into the receiver 30.

2.5. Steps (a) and (b) are repeated for the same test sample using different bottom disks having orifices of gradually increasing orifice sizes. At the beginning when the bottom disks with relatively smaller orifices are used, the flow of the test sample typically stops at some point due to jamming, i.e., it cannot pass through the orifice due to the small orifice size. Once the flow of test sample stops and remains stopped for 30 seconds or more, a jam is declared, and the specific bottom disk causing the jam is removed and replaced by another bottom disk with an orifice that is slightly larger for another repeat of steps (a) and (b). When the test sample is able to flow completely through an orifice of a specific size for three (3) consecutive times without jamming, such orifice size is recorded as the FloDex Blockage Parameter of the sample tested. The smaller the FloDex Blockage Parameter, the better the flowability of the test sample (i.e., it can flow through smaller orifices without jamming).

2.6. The flowability test result are tabulated in Table VI:

TABLE VI

| | Inventive Laundry Detergent Sample I | Comparative Laundry Detergent Sample II |
|---|---|---|
| FloDex Blockage Parameter (Orifice Size Passed) | 8 | 18 |

Conclusion:

The above results show that flowability of the Inventive Laundry Detergent Sample I containing the Inventive Particle A of the present invention is significantly better than the Comparative Detergent Sample II, which contains alkoxylated polyalkyleneimine polymer that is sprayed onto base detergent granules. This indicates that the structured particle of the present invention containing the alkoxylated polyalkyleneimine polymer can also be used to improve the flowability of finished laundry detergent products.

Example 3

Comparative Test Showing De-foaming Effect of the Structured Particles

The Inventive Laundry Detergent Sample I and the Comparative Laundry Detergent Sample II described in Example 1 are further tested for their sudsing profile during wash, according to the following steps:

3.1. Measure a homogenous portion (0.9 gram) from each of the Inventive Laundry Detergent Sample I and Comparative Laundry Detergent Sample II and test it for the suds profile by using a SITA Foam Tester R2000 (commercially available from SITA Messtechnik GmbH Gostritzer Strasse 6301217 Dresden Germany). The revolution speed of the SITA Foam Test R2000 is set at 1000RPM. Each sample is added into a test tube in the SITA Foam Test R2000 that has a diameter of 12 cm and contains 250 ml of deionized water, which is then spun at 1000RPM. The suds volume so generated is measured at every 10 seconds for a total of 150 seconds.

3.2. Each sample is tested three times, and the testing results of all three times are averaged and recorded as the final suds volume generated at a particular time point.

3.3. The suds volumes measured at 10 seconds, 20 seconds and 30 seconds are recorded, and the suds profile of each sample is then calculated by averaging the three suds volumes measurements taken at these time points.

Following are the recorded suds volumes and the suds profile calculated for the above-described Inventive Laundry Detergent Sample I and Comparative Laundry Detergent Sample II:

TABLE VII

| | Suds Volume (ml) | | | Suds Profile |
|---|---|---|---|---|
| | 10 s | 20 s | 30 s | (ml) |
| Inventive Detergent Sample I | 39 | 89 | 148 | 92 |
| (Standard deviation—SD) | (2) | (2) | (1) | |
| Comparative Detergent Sample II | 56 | 103 | 160 | 107 |
| (SD) | (1) | (3) | (4) | |

Conclusion:

The Inventive Laundry Detergent Sample I containing the structured particles within the scope of the present invention has a 14% reduction in suds volume in comparison with the Comparative Detergent Sample II containing the alkoxylated polyalkyleneimine polymer sprayed on to base detergent granules, which is surprising and unexpected. This indicates that the structured particles of the present invention may be useful for forming low suds laundry detergent products.

Example 4

Exemplary Structured Particle Formulations

TABLE VIII

| Ingredients (wt %) | Example 1 | Example 2 |
|---|---|---|
| Alkoxylated PEI | 25-40% | 20-30% |
| Sodium carbonate | 30-40% | 40-60% |
| Sodium sulphate | 0 | 20-30% |
| Silica (SN340) | 10-15% | 3-5% |
| Moisture | <4% | <4% |

Example 5

Exemplary Formulations of Granular Laundry Detergent Compositions

| Ingredient | Amount |
|---|---|
| Structured Particles 1 and 2 of Example 4 | from about 1 wt % to about 10 wt % |
| Amylase (Stainzyme Plus ®, having an enzyme activity of 14 mg active enzyme/g) | from about 0.1 wt % to about 0.5 wt % |
| Anionic detersive surfactant (such as alkyl benzene sulphonate, alkyl ethoxylated sulphate and mixtures thereof) | from about 8 wt % to about 15 wt % |
| Non-ionic detersive surfactant (such as alkyl ethoxylated alcohol) | from about 0.5 wt % to 4 wt % |
| Cationic detersive surfactant (such as quaternary ammonium compounds) | from about 0 wt % to about 4 wt % |
| Other detersive surfactant (such as zwiterionic detersive surfactants, amphoteric surfactants and mixtures thereof) | from about 0 wt % to 4 wt % |
| Carboxylate polymer (such as co-polymers of maleic acid and acrylic acid) | from about 1 wt % to about 4 wt % |
| Polyethylene glycol polymer (such as a polyethylene glycol polymer comprising poly vinyl acetate side chains) | from about 0 wt % to about 4 wt % |
| Polyester soil release polymer (such as Repel-o-tex and/or Texcare polymers) | from about 0.1 wt % to about 2 wt % |
| Cellulosic polymer (such as carboxymethyl cellulose, methyl cellulose and combinations thereof) | from about 0.5 wt % to about 2 wt % |
| Other polymer (such as amine polymers, dye transfer inhibitor polymers, hexamethylenediamine derivative polymers, and mixtures thereof) | from about 0 wt % to about 4 wt % |

-continued

| Ingredient | Amount |
|---|---|
| Zeolite builder and phosphate builder (such as zeolite 4A and/or sodium tripolyphosphate) | from about 0 wt % to about 4 wt % |
| Other builder (such as sodium citrate and/or citric acid) | from about 0 wt % to about 3 wt % |
| Carbonate salt (such as sodium carbonate and/or sodium bicarbonate) | from about 15 wt % to about 30 wt % |
| Silicate salt (such as sodium silicate) | from about 0 wt % to about 10 wt % |
| Filler (such as sodium sulphate and/or bio-fillers) | from about 10 wt % to about 40 wt % |
| Source of available oxygen (such as sodium percarbonate) | from about 10 wt % to about 20 wt % |
| Bleach activator (such as tetraacetylethylene diamine (TAED) and/or nonanoyloxybenzenesulphonate (NOBS) | from about 2 wt % to about 8 wt % |
| Bleach catalyst (such as oxaziridinium-based bleach catalyst and/or transition metal bleach catalyst) | from about 0 wt % to about 0.1 wt % |
| Other bleach (such as reducing bleach and/or pre-formed peracid) | from about 0 wt % to about 10 wt % |
| Chelant (such as ethylenediamine-N'N'-disuccinic acid (EDDS) and/or hydroxyethane diphosphonic acid (HEDP) | from about 0.2 wt % to about 1 wt % |
| Photobleach (such as zinc and/or aluminium sulphonated phthalocyanine) | from about 0 wt % to about 0.1 wt % |
| Hueing agent (such as direct violet 99, acid red 52, acid blue 80, direct violet 9, solvent violet 13 and any combination thereof) | from about 0 wt % to about 0.5 wt % |
| Brightener (such as brightener 15 and/or brightener 49) | from about 0.1 wt % to about 0.4 wt % |
| Protease (such as Savinase, Polarzyme, Purafect, FN3, FN4 and any combination thereof, typically having an enzyme activity of from about 20 mg to about 100 mg active enzyme/g) | from about 0.1 wt % to about 1.5 wt % |
| Amylase (such as Termamyl ®, Termamyl Ultra ®, Natalase ®, Optisize HT Plus ®, Powerase ®, Stainzyme ® and any combination thereof, typically having an enzyme activity of from about 10 mg to about 50 mg active enzyme/g) | from about 0.05 wt % to about 0.2 wt % |
| Cellulase (such as Carezyme ®, Celluzyme ® and/or Celluclean ®, typically having an enzyme activity of from 10 to 50 mg active enzyme/g) | from about 0.05 wt % to about 0.5 wt % |
| Lipase (such as Lipex ®, Lipolex ®, Lipoclean ® and any combination thereof, typically having an enzyme activity of from about 10 mg to about 50 mg active enzyme/g) | from about 0.2 wt % to about 1 wt % |
| Other enzyme (such as xyloglucanase (e.g., Whitezyme ®), cutinase, pectate lyase, mannanase, bleaching enzyme, typically having an enzyme activity of from about 10 mg to about 50 mg active enzyme/g) | from 0 wt % to 2 wt % |
| Fabric softener (such as montmorillonite clay and/or polydimethylsiloxane (PDMS)) | from 0 wt % to 15 wt % |
| Flocculant (such as polyethylene oxide) | from 0 wt % to 1 wt % |
| Suds suppressor (such as silicone and/or fatty acid) | from 0 wt % to 0.1 wt % |
| Perfume (such as perfume microcapsule, spray-on perfume, starch encapsulated perfume accords, perfume loaded zeolite, and any combination thereof) | from 0.1 wt %to 1 wt % |
| Aesthetics (such as colored soap rings and/or colored speckles/noodles) | from 0 wt % to 1 wt % |
| Miscellaneous | Balance |

*All enzyme levels expressed as rug active enzyme protein per 100 g detergent composition.

Surfactant ingredients can be obtained from BASF, Ludwigshafen, Germany (Lutensol®); Shell Chemicals, London, UK; Stepan, Northfield, Ill., USA; Huntsman, Huntsman, Salt Lake City, Utah, USA; Clariant, Sulzbach, Germany (Praepagen®).

Sodium tripolyphosphate can be obtained from Rhodia, Paris, France.

Zeolite can be obtained from Industrial Zeolite (UK) Ltd, Grays, Essex, UK.

Citric acid and sodium citrate can be obtained from Jungbunzlauer, Basel, Switzerland.

NOBS is sodium nonanoyloxybenzenesulfonate, supplied by Eastman, Batesville, Ark., USA.

TAED is tetraacetylethylenediamine, supplied under the Peractive® brand name by Clariant GmbH, Sulzbach, Germany.

Sodium carbonate and sodium bicarbonate can be obtained from Solvay, Brussels, Belgium.

Polyacrylate, polyacrylate/maleate copolymers can be obtained from BASF, Ludwigshafen, Germany.

Repel-O-Tex® can be obtained from Rhodia, Paris, France.

Texcare® can be obtained from Clariant, Sulzbach, Germany.

Sodium percarbonate and sodium carbonate can be obtained from Solvay, Houston, Tex., USA.

Na salt of Ethylenediamine-N,N'-disuccinic acid, (S,S) isomer (EDDS) was supplied by Octel, Ellesmere Port, UK.

Hydroxyethane di phosphonate (HEDP) was supplied by Dow Chemical, Midland, Mich., USA.

Enzymes Savinase®, Savinase® Ultra, Stainzyme® Plus, Lipex®, Lipolex®, Lipoclean®, Celluclean®, Carezyme®, Natalase®, Stainzyme®, Stainzyme® Plus, Termamyl®, Termamyl® ultra, and Mannaway® can be obtained from Novozymes, Bagsvaerd, Denmark.

Enzymes Purafect®, FN3, FN4 and Optisize can be obtained from Genencor International Inc., Palo Alto, Calif., US.

Direct violet 9 and 99 can be obtained from BASF DE, Ludwigshafen, Germany.

Solvent violet 13 can be obtained from Ningbo Lixing Chemical Co., Ltd. Ningbo, Zhejiang, China.

Brighteners can be obtained from Ciba Specialty Chemicals, Basel, Switzerland.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A structured particle comprising:

(a) from 10 wt % to 50 wt % of an alkoxylated polyalkyleneimine;

(b) from 35 wt % to 70 wt % of a water-soluble alkali metal carbonate; and (c) from 1 wt % to 20 wt % of silica;

(d) from 0 wt % to 40 wt % of a water-soluble alkali metal sulfate, wherein said structured particle is characterized by a particle size distribution Dw50 ranging from 250 microns to 1000 microns and a bulk density ranging from 500 to 1500 g/L, and wherein said structured particle has a total surfactant level of from 0 wt % to 5 wt %.

2. The structured particle of claim 1, wherein the alkoxylated polyalkyleneimine has an empirical formula of $(PEI)_a(CH_2CH_2O)_b(CH_2CH_2CH_2O)_c$, wherein PEI is a polyethyleneimine (PEI) core; wherein a is the average number-average molecular weight ($MW_n$) of the PEI core prior to modification, which ranges from 100 to 100,000; wherein b is the weight average number of ethylene oxide ($CH_2CH_2O$) units per nitrogen atom in the PEI core, which is an integer ranging from 0 to 60; and wherein c is the weight average number of propylene oxide ($CH_2CH_2CH_2O$) units per nitrogen atom in the PEI core, which is an integer from 0 to 60.

3. The structured particle of claim 2, wherein a ranges from 500 to 1000, b ranges from 20 to 40, and c ranges from 2 to 10.

4. The structured particle according to claim 1, comprising from 20 wt % to 40 wt % of said alkoxylated polyalkyleneimine.

5. The structured particle according to claim 1, characterized by a moisture content of less than 4% by total weight of said structured particle.

6. The structured particle according to claim 1, comprising from 35 wt % to 60 wt % of the water-soluble alkali metal carbonate, and wherein said water-soluble alkali metal carbonate is in a particulate form characterized by a particle size distribution Dw50 ranging from 10 microns to 100 microns.

7. The structured particle according to claim 1, comprising from 2 wt % to 15 wt % of said silica, wherein the silica is a hydrophilic silica comprising less than 10% residual salt by total weight of the silica, wherein said hydrophilic silica is capable of forming swollen silica particles upon hydration, and wherein said swollen silica particles have a particle size distribution Dv50 of from 1 μm to 100 μm.

8. The structured particle according to claim 1, comprising from 15 wt % to 30 wt % of the water-soluble alkali metal sulfate, and wherein said water-soluble alkali metal sulfate is in a particulate form characterized by a particle size distribution Dw50 ranging from 50 microns to 250 microns.

9. The structured particle according to claim 1, comprising from 0 wt % to 5 wt % of zeolite and or from 0 wt % to 5 wt % of phosphate.

10. A structured particle comprising:

(a) from 25 wt % to 40 wt % of an alkoxylated polyalkyleneimine having an empirical formula of $(PEI)_a(CH_2CH_2O)_b(CH_2CH_2CH_2O)_c$, wherein PEI is a polyethyleneimine (PEI) core; wherein a is the average number-average molecular weight ($MW_n$) of the PEI core prior to modification, which ranges from 500 to 1000; wherein b is the weight average number of ethylene oxide ($CH_2CH_2O$) units per nitrogen atom in the PEI core, which is an integer ranging from 20 to 40; and wherein c is the weight average number of propylene oxide ($CH_2CH_2CH_2O$) units per nitrogen atom in the PEI core, which is an integer ranging from 2 to 10;

(b) from 35 wt % to 60 wt % of sodium carbonate particles having a particle size distribution Dw50 ranging from 70 microns to 90 microns; and (c) from 10 wt % to 15 wt % of a hydrophilic silica comprising less than 10% residual salt by total weight of the silica, wherein said hydrophilic silica is capable of forming swollen silica particles upon hydration, and wherein said swollen silica particles have a particle size distribution Dv50 of from 5 μm to 50 μm, wherein said structured particle is characterized by a particle size distribution Dw50 ranging from 250 microns to 1000 microns and a bulk density ranging from 500 to 1500 g/L, and wherein said structured particle has a moisture content of less than 4 wt %.

11. A structured particle comprising:

(a) from 20 wt % to 30 wt % of an alkoxylated polyalkyleneimine having an empirical formula of $(PEI)_a(CH_2CH_2O)_b(CH_2CH_2CH_2O)_c$, wherein PEI is a polyethyleneimine (PEI) core; wherein a is the average number-average molecular weight ($MW_n$) of the PEI core prior to modification, which ranges from 500 to 1000; wherein b is the weight average number of ethylene oxide ($CH_2CH_2O$) units per nitrogen atom in the PEI core, which is an integer ranging from 20 to 40; and wherein c is the weight average number of propylene oxide ($CH_2CH_2CH_2O$) units per nitrogen atom in the PEI core, which is an integer ranging from 2 to 10;

(b) from 40 wt % to 60 wt % of sodium carbonate particles having a particle size distribution Dw50 ranging from 70 microns to 90 microns;

(c) from 3 wt % to 5 wt % of a hydrophilic silica comprising less than 10% residual salt by total weight of the silica, wherein said hydrophilic silica is capable of forming swollen silica particles upon hydration, and wherein said swollen silica particles have a particle size distribution Dv50 of from 5 μm to 50 μm; and (d) from 20 wt % to 30 wt % of sodium sulfate particles having a particle size distribution Dw50 ranging from 180 microns to 220 microns, wherein said structured particle is characterized by a particle size distribution Dw50 ranging from 250 microns to 1000 microns and a bulk density ranging from 500 to 1500 g/L, and wherein said structured particle has a moisture content of less than 4 wt %.

12. A granular detergent composition comprising from 1 wt % to 10 wt % of structured particles according to claim 11.

13. The granular detergent composition of claim 12, further comprising from 1 wt % to 99 wt % of one or more surfactants selected from the group consisting of anionic surfactants, cationic surfactants, nonionic surfactants, amphoteric surfactants, and mixtures thereof.

14. The granular detergent composition of claim 12, comprising at least one anionic surfactant selected from the group consisting of $C_{10}$-$C_{20}$ linear alkylbenzene sulphonates (LAS), $C_{10}$-$C_{20}$ linear or branched alkyl sulfates (AS), $C_{10}$-$C_{20}$ linear or branched alkylalkoxy sulfates having a weight average degree of alkoxylation ranging from 0.1 to 10, and mixtures thereof.

15. The granular detergent composition of claim 12, further comprising from 0.1 wt % to 1 wt % of a silicone-containing particle comprising a silicone-derived anti-foaming agent and a particulate carrier material.

16. A method of forming structured particles, comprising the steps of:

(a) providing from 10 part to 50 parts, by a total weight of 100 parts, of an alkoxylated polyalkyleneimine in a paste form; and (b) mixing the alkoxylated polyalkyleneimine paste with from 35 parts to 70 parts of a water-soluble alkali metal carbonate, from 1 part to 20 parts of silica, and from 0 parts to 40 parts of a water-soluble alkali metal sulfate, by a total weight of 100 parts, to form structured particles, wherein the water-soluble alkali metal carbonate is in a particulate form having a particle size distribution Dw50 ranging from 10 microns to 100 microns, wherein the silica is in a particulate form characterized by a particle size distribution Dw50 ranging from 3 microns to 30 microns, and wherein the water-soluble alkali metal sulfate is in a particulate form characterized by a particle size distribution Dw50 ranging from 50 microns to 250 microns, wherein the structured particles so formed are characterized by a particle size distribution Dw50 ranging from 250 microns to 1000 microns and a bulk density ranging from 500 to 1500 g/L.

* * * * *